US008198525B2

(12) United States Patent
Homburg

(10) Patent No.: US 8,198,525 B2
(45) Date of Patent: Jun. 12, 2012

(54) COLLECTIVELY ADJUSTING TRACKS USING A DIGITAL AUDIO WORKSTATION

(75) Inventor: Clemens Homburg, Hamburg (DE)

(73) Assignee: Apple Inc., Cupertino, CA (US)

( * ) Notice: Subject to any disclaimer, the term of this patent is extended or adjusted under 35 U.S.C. 154(b) by 346 days.

(21) Appl. No.: 12/505,863

(22) Filed: Jul. 20, 2009

(65) Prior Publication Data

US 2011/0011243 A1 Jan. 20, 2011

(51) Int. Cl.
*G10H 1/00* (2006.01)

(52) U.S. Cl. ..... 84/612; 84/619; 84/636; 84/645; 84/652; 84/657; 84/668

(58) Field of Classification Search ..... 84/612, 84/619, 636, 645, 652, 657, 668
See application file for complete search history.

(56) References Cited

U.S. PATENT DOCUMENTS

| | | | | |
|---|---|---|---|---|
| 5,792,971 | A * | 8/1998 | Timis et al. | 84/609 |
| 5,792,972 | A | 8/1998 | Houston | |
| 7,705,230 | B2 * | 4/2010 | Bowen | 84/612 |
| 7,973,231 | B2 * | 7/2011 | Bowen | 84/612 |
| 2006/0054005 | A1 | 3/2006 | Miyajima et al. | |
| 2006/0107822 | A1 * | 5/2006 | Bowen | 84/612 |
| 2006/0259862 | A1 | 11/2006 | Adams et al. | |
| 2008/0034948 | A1 | 2/2008 | Sumita | |
| 2010/0132536 | A1 * | 6/2010 | O'Dwyer | 84/609 |
| 2011/0011243 | A1 * | 1/2011 | Homburg | 84/612 |
| 2011/0011244 | A1 * | 1/2011 | Homburg | 84/612 |
| 2011/0011245 | A1 * | 1/2011 | Adam et al. | 84/612 |
| 2011/0011246 | A1 * | 1/2011 | Buskies et al. | 84/613 |

* cited by examiner

*Primary Examiner* — David S. Warren
(74) *Attorney, Agent, or Firm* — Novak Druce + Quigg LLP

(57) ABSTRACT

A computer implemented method allows a user to collectively adjust tracks in a digital workstation. The method includes causing the display of at least one internal track and at least one external track. The method then allows the collective adjusting of the tempo, tempo and pitch, or tuning of each internal track and each external track in response to receiving a command. The adjusted tempo and/or adjusted tuning value can be displayed.

17 Claims, 6 Drawing Sheets

400

500

COLLECTIVELY ADJUSTING TRACKS USING A DIGITAL AUDIO WORKSTATION

FIELD

The following relates to computing devices capable of and methods for arranging music, and more particularly to approaches for collectively adjusting tracks in a digital audio workstation.

BACKGROUND

Artists can use software to create musical arrangements. This software can be implemented on a computer to allow an artist to write, record, edit, and mix musical arrangements. Typically, such software can allow the artist to arrange files on musical tracks in a musical arrangement. A computer that includes the software can be referred to as a digital audio workstation (DAW). The DAW can display a graphical user interface (GUI) to allow a user to manipulate files on tracks. The DAW can display each element of a musical arrangement, such as a guitar, microphone, or drums, on separate tracks. For example, a user may create a musical arrangement with a guitar on a first track, a piano on a second track, and vocals on a third track. The DAW can further break down an instrument into multiple tracks. For example, a drum kit can be broken into multiple tracks with the snare, kick drum, and hi-hat each having its own track. By placing each element on a separate track a user is able to manipulate a single track, without affecting the other tracks. For example, a user can adjust the volume or pan of the guitar track, without affecting the piano track or vocal track. As will be appreciated by those of ordinary skill in the art, using the GUI, a user can apply different effects to a track within a musical arrangement. For example, volume, pan, compression, distortion, equalization, delay, and reverb are some of the effects that can be applied to a track.

Typically, a DAW works with two main types of files: MIDI (Musical Instrument Digital Interface) files and audio files. MIDI is an industry-standard protocol that enables electronic musical instruments, such as keyboard controllers, computers, and other electronic equipment, to communicate, control, and synchronize with each other. MIDI does not transmit an audio signal or media, but rather transmits "event messages" such as the pitch and intensity of musical notes to play, control signals for parameters such as volume, vibrato and panning, cues, and clock signals to set the tempo. As an electronic protocol, MIDI is notable for its widespread adoption throughout the industry.

Using a MIDI controller coupled to a computer, a user can record MIDI data into a MIDI track. Using the DAW, the user can select a MIDI instrument that is internal to a computer and/or an external MIDI instrument to generate sounds corresponding to the MIDI data of a MIDI track. The selected MIDI instrument can receive the MIDI data from the MIDI track and generate sounds corresponding to the MIDI data which can be produced by one or more monitors or speakers. For example, a user may select a piano software instrument on the computer to generate piano sounds and/or may select a tenor saxophone instrument on an external MIDI device to generate saxophone sounds corresponding to the MIDI data. If MIDI data from a track is sent to an internal software instrument, this track can be referred to as an internal track. If MIDI data from a track is sent to an external software instrument, this track can be referred to as an external track.

Audio files are recorded sounds. An audio file can be created by recording sound directly into the system. For example, a user may use a guitar to record directly onto a guitar track or record vocals, using a microphone, directly onto a vocal track. As will be appreciated by those of ordinary skill in the art, audio files can be imported into a musical arrangement. For example, many companies professionally produce audio files for incorporation into musical arrangements. In another example, audio files can be downloaded from the Internet. Audio files can include guitar riffs, drum loops, and any other recorded sounds. Audio files can be in sound digital file formats such as WAV, MP3, M4A, and AIFF. Audio files can also be recorded from analog sources, including, but not limited to, tapes and records.

Using the DAW, a user can make tempo changes to a musical composition. The tempo changes affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of sound generators played by the MIDI data. This occurs because the same sound generators are being triggered by the MIDI data at a faster rate. However, tempo changes to an audio file inherently adjust the pitch of the file as well. For example, if an audio file is sped up, the pitch of the sound goes up. Conversley, if an audio file is slowed, the pitch of the sound goes down. Conventional DAWs can use a process known as time stretching to adjust the tempo of audio while maintaining the original pitch. This process requires analysis and processing of the original audio file. Those of ordinary skill in the art will recognize that various algorithms and methods for adjusting the tempo of audio files while maintaining a consistent pitch can be used.

Conventional DAWs are limited in that time stretching audio files is typically done to individual audio files. Thus, a musical arrangement having twelve (12) audio tracks would need to have time stretching performed twelve (12) independent times. Conventional DAWs cannot collectively adjust the speed or speed and pitch of internal files (audio and/or MIDI) along with external MIDI files. Similarly, conventional DAWs cannot collectively detune internal audio and MIDI files along with external MIDI files. This can occur for example, when a user wishes to play a live instrument that is slightly out of tune, such as a guitar. In this example, all internal MIDI tracks, external MIDI tracks, and audio files need to be adjusted individually by the desired tuning.

SUMMARY

As introduced above, users may desire to collectively adjust at least one of tempo, tempo and pitch, and tuning of each internal track and each external track in a digital audio workstation. A computer implemented method allows a user to collectively adjust tracks in a musical arrangement. The method includes the DAW displaying at least one internal track and at least one external track, with the DAW generating sounds corresponding to each of the internal tracks and an external processor generating sounds corresponding to each of the external tracks. The DAW can also collectively adjust the tempo, tempo and pitch, and/or tuning of each internal track and each external track in response to receiving a command. Each internal track can be either an audio track or a MIDI track and each external track can be a MIDI track.

Many other aspects and examples will become apparent from the following disclosure.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION

The functions described as being performed at various components can be performed at other components, and the various components can be combined and/or separated. Other modifications also can be made.

Thus, the following disclosure ultimately will describe systems, computer readable media, devices, and methods for collectively adjusting at least one of tempo, tempo and pitch, and tuning of each internal track and each external track in a digital audio workstation. Many other examples and other characteristics will become apparent from the following description.

Figure 1:
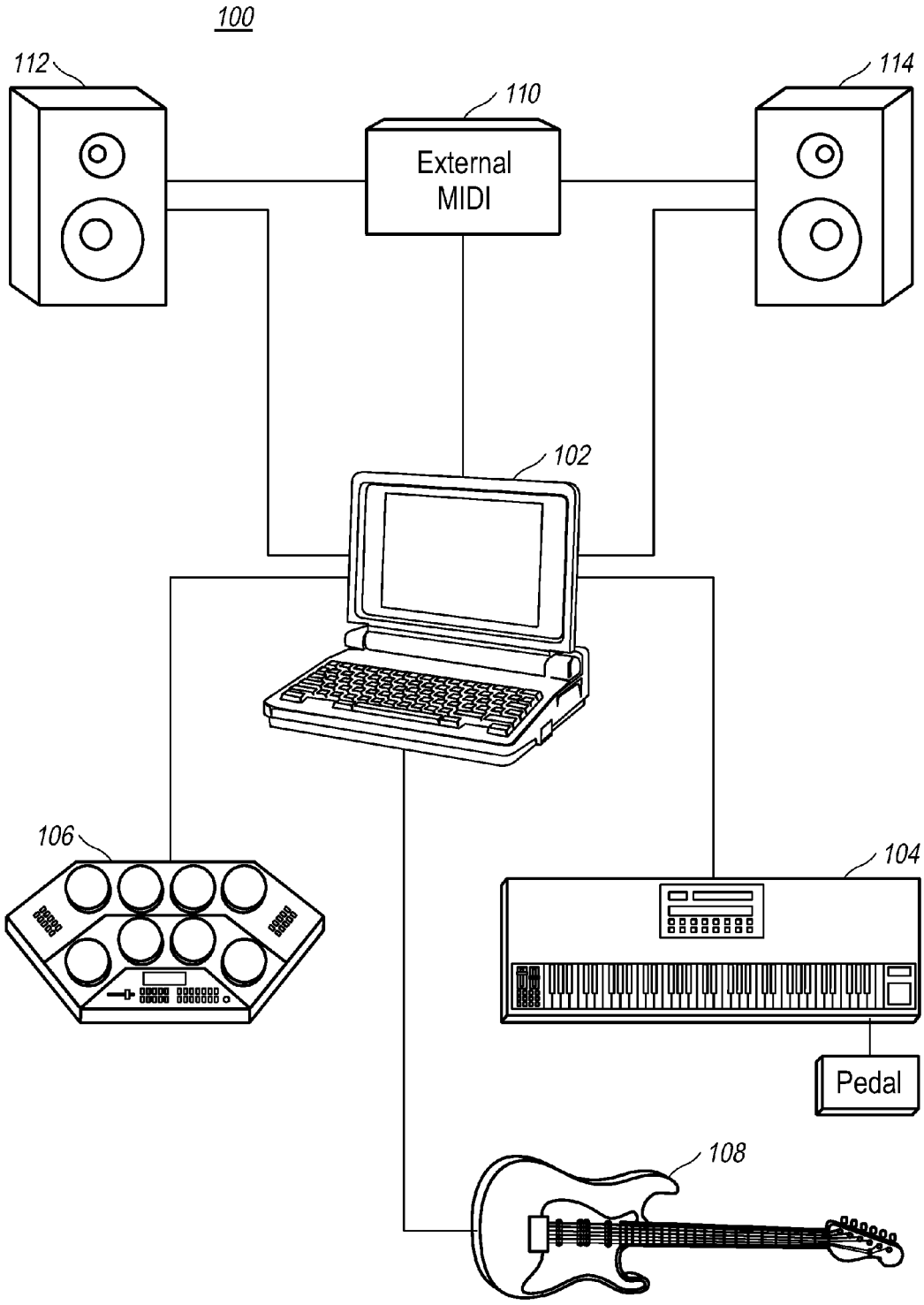
FIG. 1 depicts a block diagram of a system having a DAW musical arrangement in accordance with an exemplary embodiment.

Referring to FIG. 1, a block diagram of a system including a DAW in accordance with an exemplary embodiment is illustrated. As shown, the system 100 can include a computer 102, one or more sound output devices 112, 114, one or more MIDI controllers (e.g. a MIDI keyboard 104 and/or a drum pad MIDI controller 106), one or more instruments (e.g. a guitar 108, and/or a microphone (not shown)), and/or one or more external MIDI devices 110. As would be appreciated by one of ordinary skill in the art, the musical arrangement can include more or less equipment as well as different musical instruments.

The computer 102 can be a data processing system suitable for storing and/or executing program code, e.g., the software to operate the GUI which together can be referred to as a, DAW. The computer 102 can include at least one processor, e.g., a first processor, coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters. In one or more embodiments, the computer 102 can be a desktop computer or a laptop computer.

A MIDI controller is a device capable of generating and sending MIDI data. The MIDI controller can be coupled to and send MIDI data to the computer 102. The MIDI controller can also include various controls, such as slides and knobs, that can be assigned to various functions within the DAW. For example, a knob may be assigned to control the pan on a first track. Also, a slider can be assigned to control the volume on a second track. Various functions within the DAW can be assigned to a MIDI controller in this manner. The MIDI controller can also include a sustain pedal and/or an expression pedal. These can affect how a MIDI instrument plays MIDI data. For example, holding down a sustain pedal while recording MIDI data can cause an elongation of the length of the sound played if a piano software instrument has been selected for that MIDI track.

As shown in FIG. 1, the system 100 can include a MIDI keyboard 104 and/or a drum pad controller 106. The MIDI keyboard 104 can generate MIDI data which can be provided to a device that generates sounds based on the received MIDI data. The drum pad MIDI controller 106 can also generate MIDI data and send this data to a capable device which generates sounds based on the received MIDI data. The MIDI keyboard 104 can include piano style keys, as shown. The drum pad MIDI controller 106 can include rubber pads. The rubber pads can be touch and pressure sensitive. Upon hitting or pressing a rubber pad, or pressing a key, the MIDI controller (104,106) generates and sends MIDI data to the computer 102.

An instrument capable of generating electronic audio signals can be coupled to the computer 102. For example, as shown in FIG. 1, an electrical output of an electric guitar 108 can be coupled to an audio input on the computer 102. Similarly, an acoustic guitar 108 equipped with an electrical output can be coupled to an audio input on the computer 102. In another example, if an acoustic guitar 108 does not have an electrical output, a microphone positioned near the guitar 108 can provide an electrical output that can be coupled with an audio input on the computer 102. The output of the guitar 108 can be coupled to a pre-amplifier (not shown) with the pre-amplifier being coupled to the computer 102. The pre-amplifier can boost the electronic signal output of the guitar 108 to acceptable operating levels for the audio input of computer 102. If the DAW is in a record mode, a user can play the guitar 108 to generate an audio file. Popular effects such as chorus, reverb, and distortion can be applied to this audio file when recording and playing.

The external MIDI device 110 can be coupled to the computer 102. The external MIDI device 110 can include a processor 118, e.g., a second processor which is external to the first processor 102. The external processor 118 can receive MIDI data from an external MIDI track of a musical arrangement to generate corresponding sounds. A user can utilize such an external MIDI device 110 to expand the quality and/or quantity of available software instruments. For example, a user may configure the external MIDI device 110 to generate electric piano sounds in response to received MIDI data from a corresponding external MIDI track in a musical arrangement from the computer 102.

The computer 102 and/or the external MIDI device 110 can be coupled to one or more sound output devices (e.g., monitors or speakers). For example, as shown in FIG. 1, the computer 102 and the external MIDI device 110 can be coupled to a left monitor 112 and a right monitor 114. In one or more embodiments, an intermediate audio mixer (not shown) may be coupled between the computer 102, or external MIDI device 110, and the sound output devices, e.g., the monitors 112, 114. The intermediate audio mixer can allow a user to adjust the volume of the signals sent to the one or more sound output devices for sound balance control. In other embodiments, one or more devices capable of generating an audio signal can be coupled to the sound output devices 112, 114. For example, a user can couple the output from the guitar 108 to the sound output devices.

The one or more sound output devices can generate sounds corresponding to the one or more audio signals sent to them. The audio signals can be sent to the monitors 112, 114 which can require the use of an amplifier to adjust the audio signals to acceptable levels for sound generation by the monitors 112, 114. The amplifier in this example may be internal or external to the monitors 112, 114.

Although, in this example, a sound card is internal to the computer 102, many circumstances exist where a user can utilize an external sound card (not shown) for sending and receiving audio data to the computer 102. A user can use an external sound card in this manner to expand the number of available inputs and outputs. For example, if a user wishes to record a band live, an external sound card can provide eight (8) or more separate inputs, so that each instrument and vocal can each be recorded onto a separate track in real time. Also, disc jockeys (djs) may wish to utilize an external sound card for multiple outputs so that the dj can cross-fade to different outputs during a performance.

Figure 2:
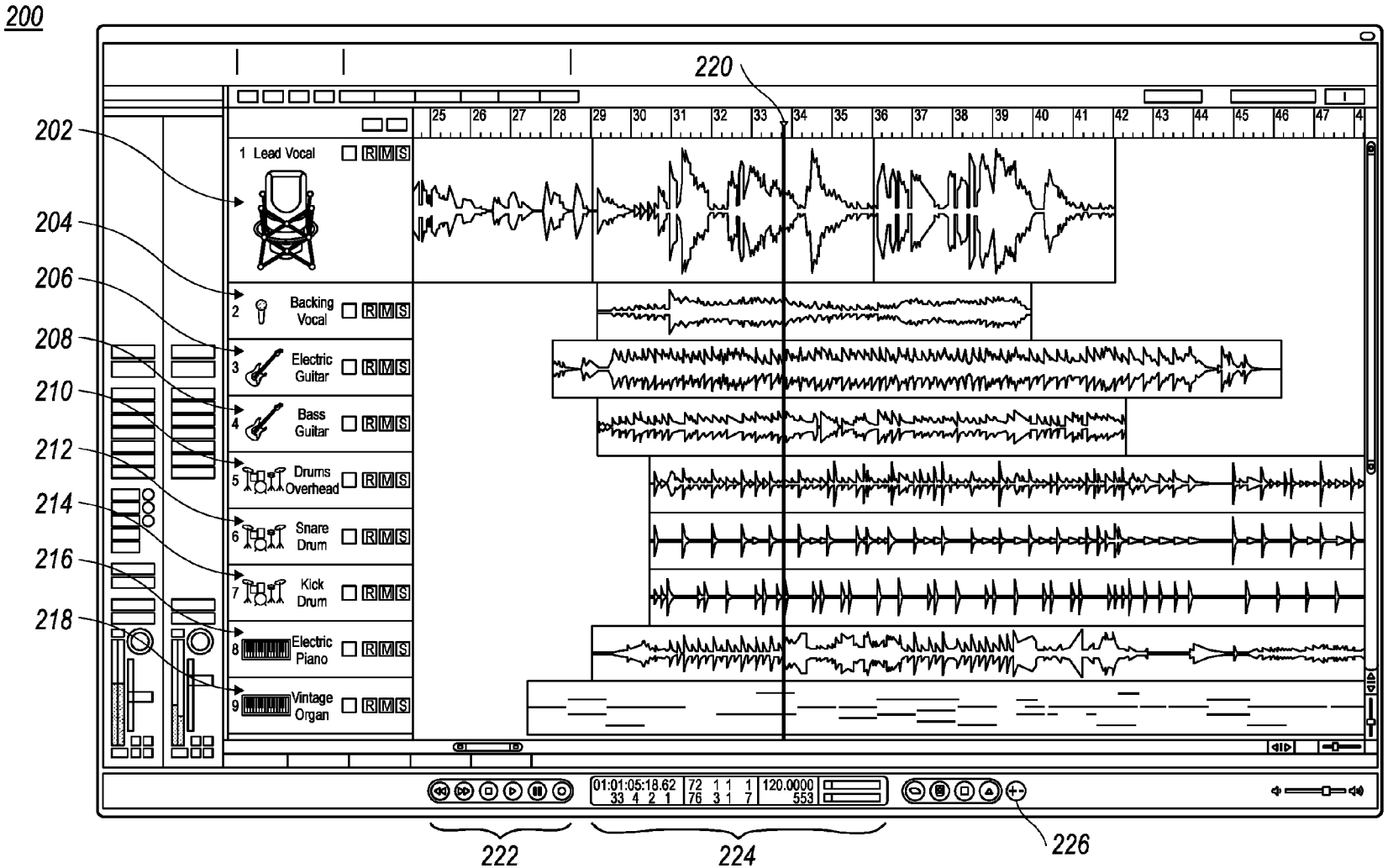
FIG. 2 depicts a screenshot of a GUI of a DAW displaying a musical arrangement including MIDI and audio tracks in accordance with an exemplary embodiment.

Referring to FIG. 2, a screenshot of a musical arrangement in a GUI of a DAW in accordance with an exemplary embodiment is illustrated. The musical arrangement 200 can include one or more tracks with each track having one or more of audio files or MIDI files. Generally, each track can hold audio or MIDI files corresponding to each individual desired instrument. As shown, the tracks are positioned horizontally. A playhead 220 moves from left to right as the musical arrangement is recorded or played. As one of ordinary skill in the art would appreciate, other tracks and playhead 220 can be displayed and/or moved in different manners. The playhead 220 moves along a timeline that shows the position of the playhead within the musical arrangement. The timeline indicates bars, which can be in beat increments. For example as shown, a four (4) beat increment in a 4/4 time signature is displayed on a timeline with the playhead 220 positioned between the thirty-third (33rd) and thirty-fourth (34th) bar of this musical arrangement. A transport bar 222 can be displayed and can include commands for playing, stopping, pausing, rewinding and fast-forwarding the displayed musical arrangement. For example, radio buttons can be used for each command. If a user were to select the play button on transport bar 222, the playhead 220 would begin to move down the timeline, e.g., in a left to right fashion.

As shown, the lead vocal track, 202, is an audio track. One or more audio files corresponding to a lead vocal part of the musical arrangement can be located on this track. In this example, a user has directly recorded audio into the DAW on the lead vocal track. The backing vocal track, 204 is also an audio track. The backing vocal 204 can contain one or more audio files having backing vocals in this musical arrangement. The electric guitar track 206 can contain one or more electric guitar audio files. The bass guitar track 208 can contain one or more bass guitar audio files within the musical arrangement. The drum kit overhead track 210, snare track 212, and kick track 214 relate to a drum kit recording. An overhead microphone can record the cymbals, hit-hat, cow bell, and any other equipment of the drum kit on the drum kit overhead track. The snare track 210 can contain one or more audio files of recorded snare hits for the musical arrangement. Similarly, the kick track 212, can contain one or more audio files of recorded bass kick hits for the musical arrangement. The electric piano track 216 can contain one or more audio files of a recorded electric piano for the musical arrangement.

The vintage organ track 218 is a MIDI track. Those of ordinary skill in the art will appreciate that the contents of the files in the vintage organ track 218 can be shown differently because the track contains MIDI data and not audio data. In this example, the user has selected an internal software instrument, a vintage organ, to output sounds corresponding to the MIDI data contained within this track 218. A user can change the software instrument, for example to a trumpet, without changing any of the MIDI data in track 218. Upon playing the musical arrangement the trumpet sounds would now be played corresponding to the MIDI data of track 218. Also, a user can set up track 218 to send its MIDI data to an external MIDI instrument, as described above.

Each of the displayed audio and MIDI files in the musical arrangement as shown on screen 200 can be altered using the GUI. For example, a user can cut, copy, paste, or move an audio file or MIDI file on a track so that it plays at a different position in the musical arrangement. Additionally, a user can loop an audio file or MIDI file so that it is repeated, split an audio file or MIDI file at a given position, and/or individually time stretch an audio file for tempo, tempo and pitch, and/or tuning adjustments as described below.

Display window 224 contains information for the user about the displayed musical arrangement. As shown, the current tempo in bpm of the musical arrangement is set to 120 bpm. The position of playhead 220 is shown to be at the thirty-third (33rd) bar beat four (4) in the display window 224. Also, the position of the playhead 220 within the song is shown in minutes, seconds etc.

Tempo changes to a musical arrangement can affect MIDI tracks and audio tracks differently. In MIDI files, tempo and pitch can be adjusted independently of each other. For example, a MIDI track recorded at 100 bpm (beats per minute) can be adjusted to 120 bpm without affecting the pitch of the samples played by the MIDI data. This occurs because the same samples are being triggered by the MIDI data, they are just being triggered faster in time. In order to change the tempo of the MIDI file, the signal clock of the relevant MIDI data is changed. However, tempo changes to an audio file inherently adjust the pitch of the file as well. For example, if an audio file is sped up, the pitch of the sound goes up. Similarly, if an audio file is slowed, the pitch of the sound goes down.

In regards to digital audio files, one way that a DAW can change the duration of an audio file to match a new tempo is to resample it. This is a mathematical operation that effectively rebuilds a continuous waveform from its samples and then samples that waveform again at a different rate. When the new samples are played at the original sampling frequency, the audio clip sounds faster or slower. In this method, the frequencies in the sample are scaled at the same rate as the speed, transposing its perceived pitch up or down in the process. In other words, slowing down the recording lowers the pitch, speeding it up raises the pitch.

A DAW can use a process known as time stretching to adjust the tempo of audio while maintaining the original pitch. This process requires analysis and processing of the original audio file. Those of ordinary skill in the art will recognize various algorithms and methods for adjusting the tempo of audio files while maintaining a consistent pitch can be used.

One way that a DAW can stretch the length of an audio file without affecting the pitch is to utilize a phase vocoder. The first step in time-stretching an audio file using this method is to compute the instantaneous frequency/amplitude relationship of the audio file using the Short-Time Fourier Transform (STFT), which is the discrete Fourier transform of a short, overlapping and smoothly windowed block of samples. The next step is to apply some processing to the Fourier transform magnitudes and phases (like resampling the FFT blocks). The third step is to perform an inverse STFT by taking the inverse Fourier transform on each chunk and adding the resulting waveform chunks.

The phase vocoder technique can also be used to perform pitch shifting, chorusing, timbre manipulation, harmonizing, and other modifications, all of which can be changed as a function of time.

Another method that can be used for time shifting audio regions is known as time domain harmonic scaling. This method operates by attempting to find the period (or equivalently the fundamental frequency) of a given section of the audio file using a pitch detection algorithm (commonly the peak of the audio file's autocorrelation, or sometimes cepstral processing), and crossfade one period into another.

The DAW can combine the two techniques (for example by separating the signal into sinusoid and transient waveforms), or use other techniques based on the wavelet transform, or artificial neural network processing, for example, for time stretching. Those of ordinary skill in the art will recognize that various algorithms and combinations thereof for time stretching audio files based on the content of the audio files and desired output can be used by the DAW.

Returning to FIG. 2, the GUI can include a global button 226. By selecting the global button 226, with for example, a computer mouse, a floating window 304 can appear. The floating window 304 can include a mode selector 306 to allow a user to choose between speed (tempo) only mode, speed and pitch mode, or tuning mode. The mode selector 306 can be in the form of a drop down menu. Those of ordinary skill in the art will appreciate that other modes and combinations can be implemented, as well as other means to select the modes can be implemented.

Figure 3:
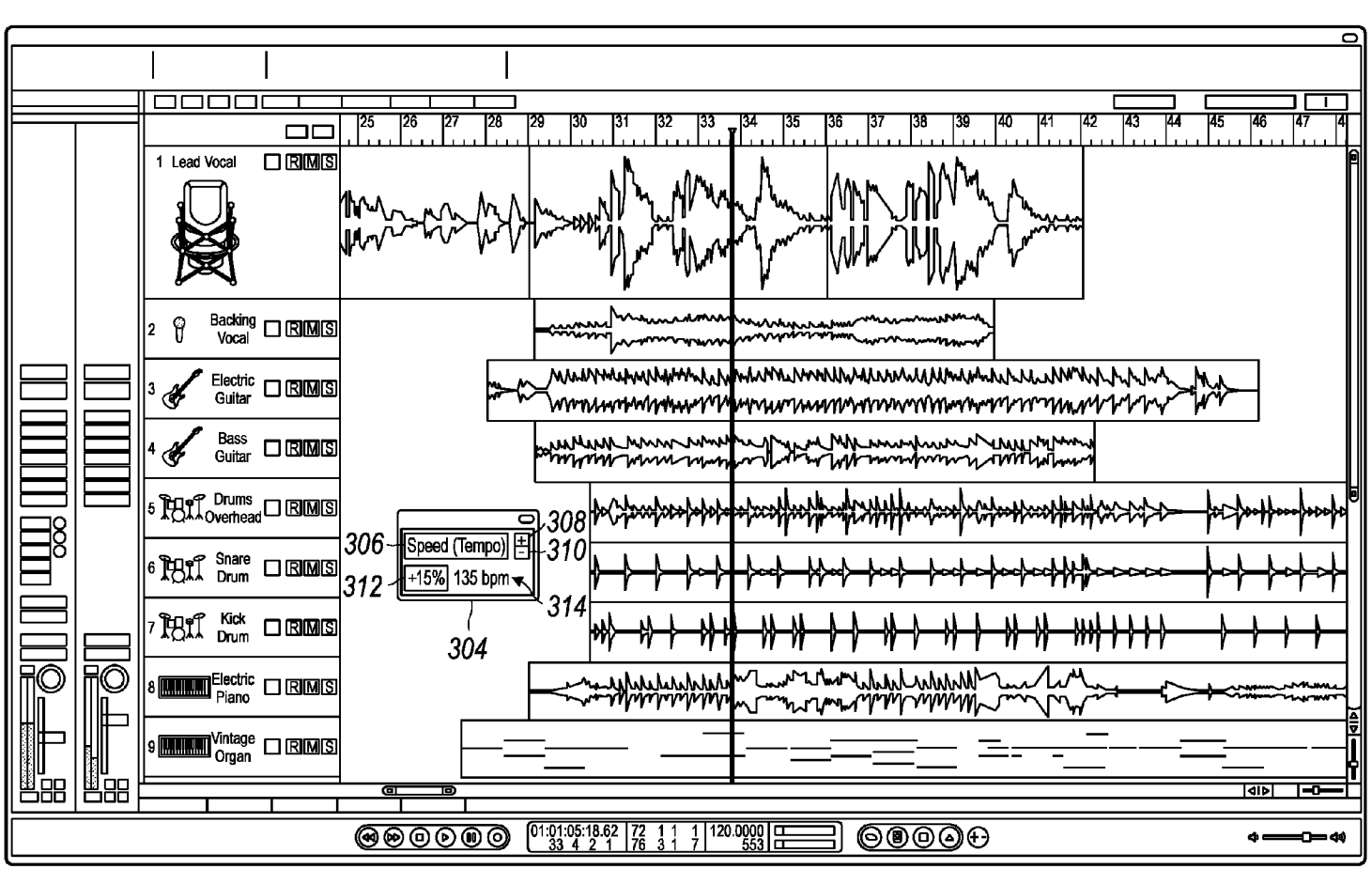
FIG. 3 depicts a screenshot of a GUI of a DAW displaying a musical arrangement including MIDI and audio tracks in which the tempo of all tracks has been collectively adjusted in accordance with an exemplary embodiment.

Referring to FIG. 3, a screenshot of a GUI of a DAW displaying a musical arrangement including MIDI and audio tracks in which the speed of all tracks has been collectively adjusted in accordance with an exemplary embodiment is illustrated. As shown, the speed (tempo) only mode is displayed in the floating window 304. The speed (tempo) only mode 306 allows a user to adjust the speed (tempo) of all tracks, including MIDI and audio tracks collectively. Specifically, the GUI allows the user to collectively adjust internal tracks (containing MIDI or audio files) and external tracks (containing MIDI files). In the example, a user can increase the overall speed or tempo of all tracks collectively by activating the plus button 308. Conversely, as shown on screen 300, a user can decrease the overall speed or tempo of all tracks collectively by activating the minus button 310. The resulting percentage increase or decrease from the original tempo is shown on display 312. Additionally, in this example, a user may double click display 312 and manually enter a positive or negative percentage to collectively adjust the tempo of all tracks in the musical arrangement as shown in screen 300. The resulting tempo 314 in bpm is also shown in floating window 304. Track 9, which is a vintage organ MIDI track can be configured to play a software instrument on an external MIDI device. In this example, upon recording or playing the track, the DAW will send MIDI commands corresponding to track 9 to an external MIDI instrument. The external MIDI instrument will receive these MIDI commands and generate the vintage organ sounds corresponding to this MIDI track. The collective adjustment of tempo (speed) will collectively affect all internal and external tracks.

In FIG. 3 the audio files can be time stretched to the new tempo, while maintaining their original pitch, by time stretching methods such as utilizing a phase vocoder or utilizing time domain harmonic scaling. As described above, DAWs can combine the two techniques (for example by separating the signal into sinusoid and transient waveforms), or use other techniques based on the wavelet transform, or artificial neural network processing, for example, for time stretching. Those of ordinary skill in the art will recognize that various algorithms and combinations thereof for time stretching audio files based on the content of the audio files and desired output can be used by the DAW.

Clock signals can control the tempo of a MIDI file. In FIG. 3, the tempo of the MIDI files can be adjusted by modifying a clock signal of the MIDI data for the MIDI files to correspond to the new tempo.

Figure 4:
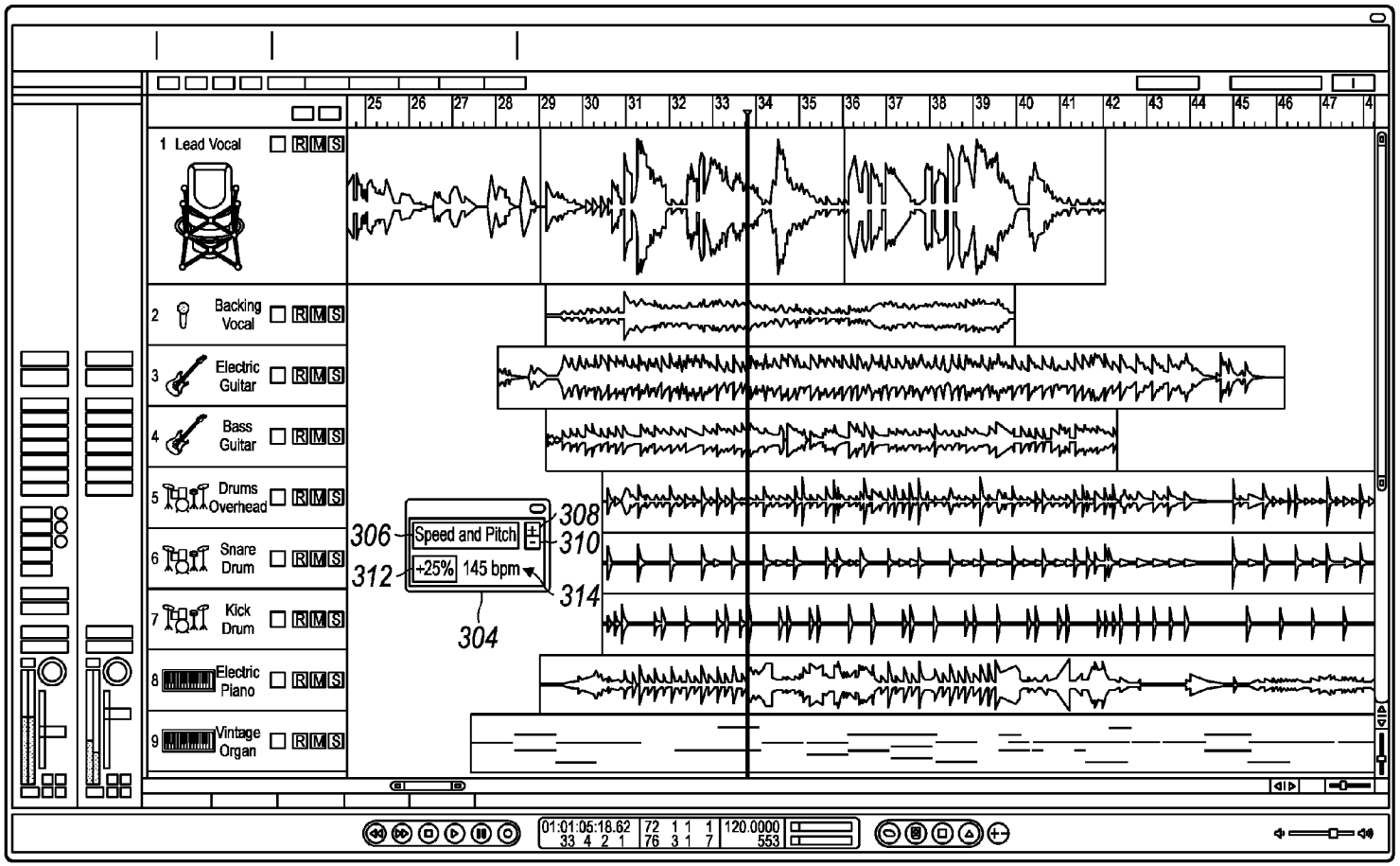
FIG. 4 depicts a screenshot of a GUI of a DAW displaying a musical arrangement including MIDI and audio tracks in which the tempo and pitch of all tracks has been collectively adjusted in accordance with an exemplary embodiment.

Referring to FIG. 4, a screenshot of a GUI of a DAW displaying a musical arrangement including MIDI and audio tracks in which the speed and pitch of all tracks has been collectively adjusted in accordance with an exemplary embodiment is illustrated. As shown, the speed and pitch mode 306 is displayed in the floating window 304. The speed and pitch mode 306 allows a user to adjust the speed and pitch of all tracks, including MIDI and audio tracks collectively. In the example shown on screen 400, a user can increase the overall speed and pitch of all tracks collectively by activating the plus button 308. Similarly, as shown on screen 400, a user can decrease the overall speed and pitch of all tracks collectively by activating the minus button 310. The resulting percentage increase or decrease from the original speed and pitch is shown on display 312. Additionally, in this example, a user may double click display 312 and manually enter a positive or negative percentage by numeric keyboard entry to collectively adjust the tempo (speed) and pitch of all tracks in the musical arrangement as shown in screen 400. The resulting tempo 314 in beats per minute is also shown in floating window 304. Speed and pitch mode 306 creates a classic tape effect whereby increasing the tempo of the tracks collectively increases their pitch. Similarly, in speed and pitch mode 306, decreasing the tempo of the tracks collectively decreases their pitch. As described above, track 9, which is a vintage organ MIDI track can be configured to play a software instrument on an external MIDI device. In this example, upon recording or playing the track, the DAW will send MIDI commands corresponding to track 9 to an external MIDI instrument. The external MIDI instrument will receive these MIDI commands and generate the vintage organ sounds corresponding to this MIDI track. The collective adjustment of tempo and pitch will collectively affect all internal and external tracks.

In a conventional DAW capable of handling MIDI data, changing the playback tempo does not change the pitch of a MIDI instrument only the speed with which the MIDI notes are triggered. The DAW and method described herein can generate MIDI notes with a new pitch that corresponds to the tempo change. While operating in speed and pitch mode the DAW can playback audio and MIDI instruments in tune. The DAW can adjust the MIDI pitch to a closest MIDI note. According to MIDI standard specifications there are 128 MIDI notes with a pitch difference of one semi note (100 cent) between two consecutive notes. This means the resolution of the possible pitch correction during speed and pitch mode can be one semi-note (or steps of 100 cents). For this reason the DAW can allow the user to adjust the tempo in semi-notes.

In FIG. 4 the audio files can be time and pitch stretched by resampling. As described above, resampling is a mathematical operation that effectively rebuilds a continuous waveform from its samples and then samples that waveform again at a different rate. When the new samples are played at the original sampling frequency, the audio clip sounds faster or slower. In this method, the frequencies in the sample are scaled at the same rate as the speed, transposing its perceived pitch up or down in the process. In other words, slowing down the recording lowers the pitch, speeding it up raises the pitch. Other methods of time and pitch shifting, such as using a phase vocoder, or other methods and combinations thereof readily known by those of ordinary skill in the art can be used to collectively time and pitch shift audio files.

As described above, clock signals control the tempo of a MIDI file. In FIG. 3, the tempo of the midi files can be adjusted by a modifying clock signal of the MIDI data for the midi files to correspond to the new tempo. The pitch adjustment of the MIDI files can be accomplished by modifying the pitch parameters of the MIDI files.

Figure 5:
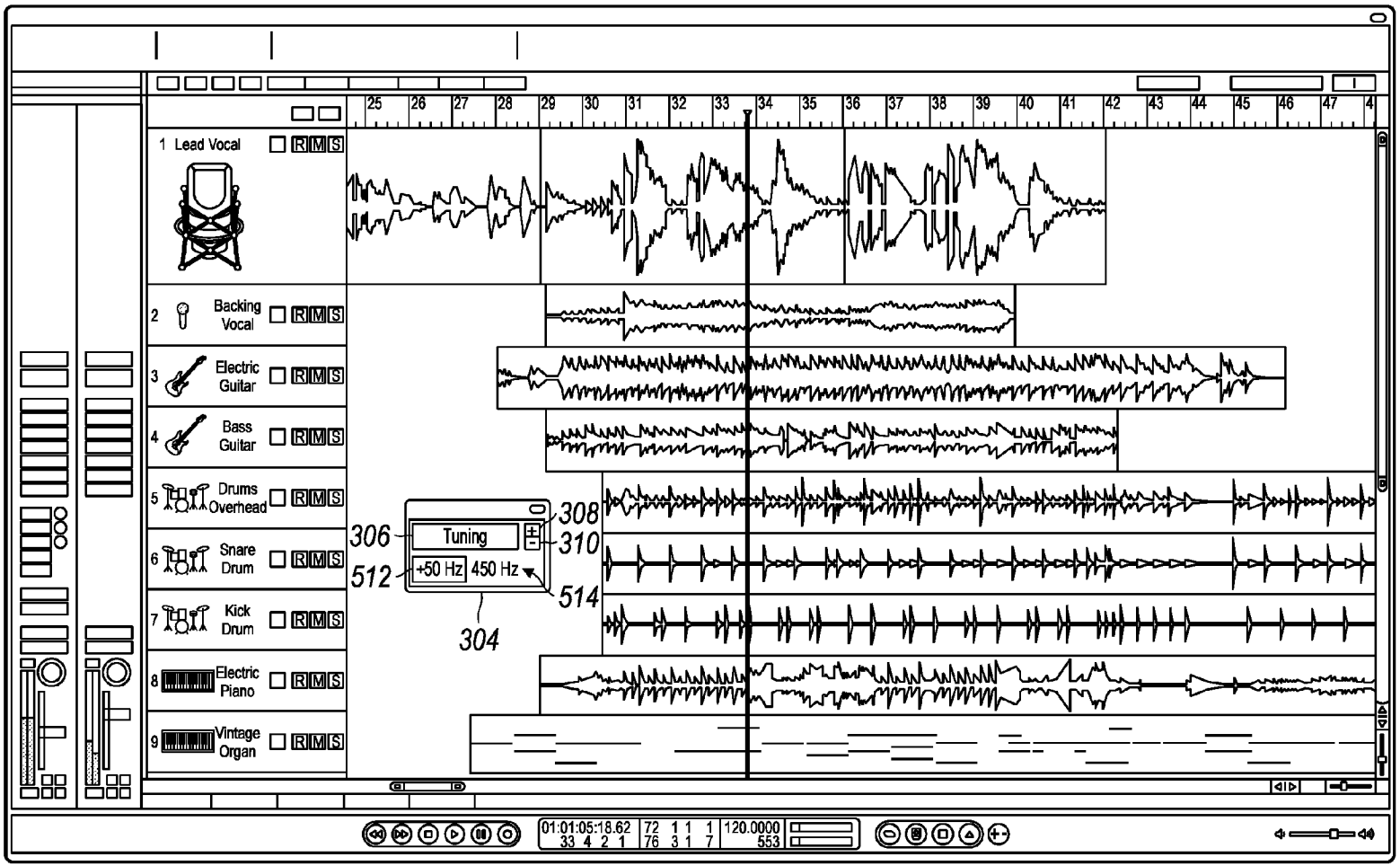
FIG. 5 depicts a screenshot of a GUI of a DAW displaying a musical arrangement including MIDI and audio tracks in which the tuning of all tracks has been collectively adjusted in accordance with an exemplary embodiment.

Referring to FIG. 5, a screenshot of a GUI of a DAW displaying a musical arrangement including MIDI and audio tracks system in which the tuning of all tracks has been collectively adjusted in accordance with an exemplary embodiment is illustrated. As shown, the tuning mode 306 mode is displayed in the floating window 304. The tuning mode 306 allows a user to adjust the tuning of all tracks, including MIDI and audio tracks collectively. In the example shown on screen 500, a user can increase the tuning of all tracks collectively by activating the plus button 308. Similarly, as shown on screen 500, a user can decrease the tuning of all tracks collectively by activating the minus button 310. The resulting percentage increase or decrease from the original tuning is shown on display 512. Additionally, in this example, a user may double click display 512 and manually enter a positive or negative percentage by numeric keyboard entry to collectively adjust the tuning of all tracks in the musical arrangement as shown in screen 500. The resulting tuning, corresponding to the closest semi-note 514 in hertz is also shown in floating window 304. As mentioned above by design of the MIDI standard specification the pitch adjusted MIDI Notes do not adjust precisely to an arbitrary entered Hz value or percentage value. In this example, there is always the inherent limitation of moving in semi-notes (100 cent) steps.

In one or more embodiments, a user can collectively adjust the tuning of all tracks, both internal and external, to match the tuning of a live instrument. For example, a user may wish to play a saxophone live and collectively adjust the tuning of all tracks in the DAW to match the tuning of the saxophone. Those of ordinary skill in the art will appreciate other uses for the collective tuning adjustment as well. As described above, track 9, which is a vintage organ MIDI track can be configured to play a software instrument on an external MIDI device. In this example, upon recording or playing the track, the DAW can send MIDI commands corresponding to track 9 to an external MIDI instrument. The external MIDI instrument can receive these MIDI commands and generate the vintage organ sounds corresponding to this MIDI track. The collective adjustment of tuning can collectively affect all internal and external tracks, including the external vintage organ.

The tuning of the MIDI files can be tuned by providing adjusted MIDI Note Numbers of the MIDI data for pitch changes. Generally, MIDI Note numbers can be recognized by almost any MIDI device, certainly by any sound generator. In another example, the tuning of the MIDI files can be adjusted by sending a MIDI Tuning System (MTS) message in the MIDI data. In this example, the MTS message uses a three-byte number format to specify a pitch in logarithmic form. This pitch number can be thought of as a three-digit number in base 128. Those of ordinary skill in the art will recognize other methods for adjusting the tuning of midi files.

The tuning of the audio files can be adjusted by pitch shifting. Pitch shifting is a process that can change the pitch of an audio file without affecting the speed. The phase vocoder method described above can be used to pitch shift the audio files to the desired tuning. Additionally, those of ordinary skill in the art will recognize other algorithms and combinations thereof for pitch shifting audio files.

Figure 6:
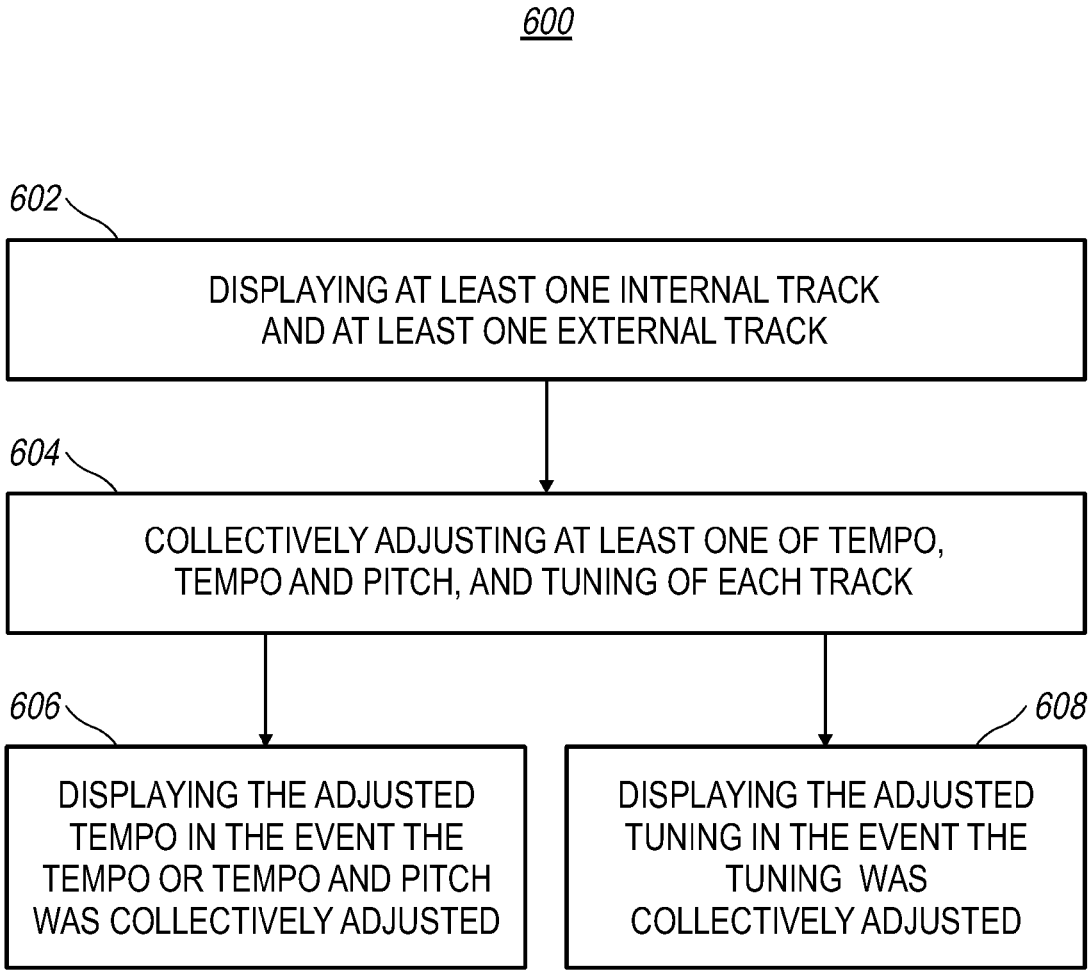
FIG. 6 illustrates a flow chart of a method for collectively adjusting internal and external tracks of a musical arrangement in accordance with an exemplary embodiment.

Referring to FIG. 6, a flow chart of a method for collectively adjusting internal and external tracks of a musical arrangement in accordance with an exemplary embodiment is illustrated. The exemplary method 600 is provided by way of example, as there are a variety of ways to carry out the method. In one or more embodiments, the method 600 is performed by the computer 102 of FIG. 1. The method 600 can be executed or otherwise performed by one or a combination of various systems. The method 600 described below can be carried out using the devices illustrated in FIG. 1 by way of example, and various elements of this Figure are referenced in explaining exemplary method 600. Each block shown in FIG. 600 represents one or more processes, methods or subroutines carried out in exemplary method 600. The exemplary method 600 can begin at block 602.

At block 602, at least one internal track and at least one external track is displayed. For example, the computer 102, e.g., first processor, causes the display of the at least one internal track and at least one external track. The computer 102, e.g., first processor, can generate corresponding sounds in response to audio files or MIDI files contained in internal tracks. The external MIDI device 110, e.g., second processor can generate sounds in response to MIDI files contained in external tracks. In another example, a display module residing on a computer-readable medium can display the at least one internal track and at least one external track. After displaying the internal and external tracks, the method 600 can proceed to block 604.

At block 604, the tempo, tempo and pitch, or tuning of each internal track and each external track in response to a received command can be collectively adjusted. For example, by clicking on the radio button a floating window appears that can allow a user to enter a desired collective adjustment mode and value.

For example, the first processor or an adjustment module can display a GUI to allow a user to collectively adjust the tempo of each internal track and each external track, as shown in FIG. 3. In this figure a user has selected a tempo only mode. A user can now adjust the tempo of all tracks collectively by activating the plus or minus buttons shown on the GUI of FIG. 3. A user can also adjust the tempo in this example by manually entering a desired percentage to adjust the collective tempo. The tempo can be adjusted by adjusting the tempo by a percentage associated with the command, the percentage being between about negative fifty percent (−50%) and one-hundred percent (100%) of each track, and the tempo being adjusted for each audio track by time stretching and for each MIDI track by changing a clock signal of the MIDI data for each MIDI track with the pitch of each track being maintained.

The first processor or an adjustment module can display a GUI to allow a user to collectively adjust the tempo and pitch of each internal track and each external track, as shown in FIG. 4. In this figure a user has selected a tempo and pitch mode. A user can now adjust the tempo and pitch of all tracks collectively by activating the plus or minus buttons shown on the GUI of FIG. 4. A user can also adjust the tempo and pitch in this example by manually entering a desired percentage to adjust the collective tempo and pitch. The tempo and pitch adjustment can be adjusted by a percentage associated with the command, the percentage being between about negative fifty percent (−50%) and one-hundred percent (100%) of each track, and the tempo and pitch being adjusted for each audio track by time stretching and for the tempo and pitch of each MIDI track being adjusted by changing a clock signal and pitch value of the MIDI data for each MIDI track.

The first processor or an adjustment module can display a GUI to allow a user to collectively adjust the tuning of each internal track and each external track, as shown in FIG. 5. In this figure a user has selected a tuning mode. A user can now adjust the tuning of all tracks collectively by activating the plus or minus buttons shown on the GUI of FIG. 5. A user can also adjust the tuning in this example by manually entering a desired percentage to adjust the collective tuning. As described above, a user can make this adjustment in semi-notes (100 cent steps).

The tuning adjustment can be adjusted for each track by an increment associated with the command, the increment being between about 220.00 Hz and 880.00 Hz, by pitch shifting each audio track by the increment and providing MIDI note values corresponding to the increment to the external processor associated with each software instrument corresponding to each MIDI track.

Returning to FIG. 6, at block 606, the adjusted tempo can be displayed in the event the tempo or tempo and pitch of the at least one internal track and at least one external track was collectively adjusted. For example, the first processor can cause a display of the adjusted tempo. In another example, the display module can cause the display of the adjusted tempo.

At block 608, the adjusted tuning can be displayed in the event the tempo or tempo and pitch of the at least one internal track and at least one external track was collectively adjusted. For example, the first processor can cause a display of the adjusted tuning. In another example, the display module can cause the display of the adjusted tuning.

The technology can take the form of an entirely hardware embodiment, an entirely software embodiment or an embodiment containing both hardware and software elements. In one embodiment, the invention is implemented in software, which includes but is not limited to firmware, resident software, microcode, etc. Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the technology can be centralized and/or distributed as known to those skilled in the art.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

I claim:

1. A computer implemented method to collectively adjust tracks, the computer implemented method comprising:

causing the display, by a first processor, of at least one internal track and at least one external track, wherein the first processor causes sounds corresponding to each of the internal tracks to be generated and at least one external processor external to the first processor causes sounds corresponding to each of the external tracks to be generated;

collectively adjusting, by the first processor, at least one of tempo, tempo and pitch, and tuning of each internal track and each external track in response to receiving a command, wherein each internal track is one of an audio track and a MIDI track and each external track is a MIDI track; and wherein collectively adjusting the tuning further comprises adjusting the tuning of each track by an increment associated with the command, the increment being between about 220.00 Hz and 880.00 Hz, by pitch shifting each audio track by the increment and providing MIDI note values corresponding to the increment to each processor associated with each software instrument corresponding to each MIDI track.

2. The computer implemented method of claim 1, wherein collectively adjusting the tempo further comprises adjusting the tempo by a percentage associated with the command, the percentage being between about negative fifty percent (−50%) and one hundred percent (100%) of each track, and the tempo being adjusted for each audio track by time stretching and for each MIDI track by changing a clock signal of the MIDI data for each MIDI track with the pitch of each track being maintained.

3. The computer implemented method of claim 2, further comprising causing the display of the adjusted tempo of each track by the first processor.

4. The computer implemented method of claim 1, wherein the collectively adjusting the tempo and pitch further comprises adjusting the tempo and pitch by a percentage associated with the command, the percentage being between about negative fifty percent (−50%) and one-hundred percent (100%) of each track, and the tempo and pitch being adjusted for each audio track by time stretching and for the tempo and pitch of each MIDI being adjusted by changing a clock signal and pitch value of the MIDI data for each MIDI track.

5. The computer implemented method of claim 4, further comprising causing the display of the adjusted tempo of each track by the first processor.

6. The computer implemented method of claim 1, wherein the collectively adjusting, of at least one of tempo, tempo and pitch, and tuning of each internal track and each external track is accessed by selecting a radio button.

7. A computer program product for collectively adjusting tracks, the computer program product comprising:

at least one computer-readable medium;

at least one display module residing on the computer-readable medium and operative to cause the display of at least one internal track and at least one external track, wherein a first processor causes sounds corresponding to each of the internal tracks to be generated and at least one external processor external to the first processor causes sounds corresponding to each of the external tracks to be generated;

at least one adjustment module residing on the computer-readable medium and operative to collectively adjust at least one of tempo, tempo and pitch, and tuning of each internal track and each external track in response to receiving a command, wherein each internal track is one of an audio track and a MIDI track and each external track is a MIDI track; and wherein the adjustment module is operative to collectively adjust the tuning by an increment associated with the command, the increment being between about 220.00 Hz and 880.00 Hz, by pitch shifting each audio track being by the increment and providing MIDI note values to each processor associated with each software instrument corresponding to each MIDI track.

8. The computer program product of claim 7, wherein the adjustment module is operative to collectively adjust the tempo by a percentage associated with the command, the percentage being between about negative fifty percent (−50%) and one-hundred percent (100%) of each track, and the tempo being adjusted for each audio track by time stretching and for each MIDI track by changing a clock signal of the MIDI data for each MIDI track with the pitch of each track being maintained.

9. The computer program product of claim 8, further comprising the at least one display module operative to display the adjusted tempo of each track.

10. The computer program product of claim 7, wherein the adjustment module is operative to collectively adjust the tempo and pitch by a percentage associated with the command, the percentage being between about negative fifty percent (−50%) and one hundred percent (100%) of each track, and the tempo and pitch being adjusted for each audio track by time stretching and for the tempo and pitch of each MIDI track being adjusted by changing a clock signal and note values of the MIDI data for each MIDI track.

11. The computer program product of claim 10, further comprising the at least one display module operative to display the adjusted tempo of each track.

12. A system for collectively adjusting tracks, the system comprising:

a display for displaying at least one internal track and at least one external track;

a first processor, communicatively coupled to the display and operative to provide the at least one internal track and at least one external track to the display, to a second processor, and to one or more speakers;

a second processor, communicatively coupled to the first processor, operative to provide each external track to one or more speakers;

one or more speakers operative to generate audio in response to receiving at least one of the internal tracks and the external tracks, wherein the first processor is operative to collectively adjust at least one of tempo, tempo and pitch, and tuning of each internal track and each external track in response to receiving a command, wherein each internal track is one of an audio track and a MIDI track and each external track is a MIDI track; and wherein the first processor is operative to collectively adjust the tuning by an increment associated with the command, the increment being between about 220.00 Hz and 880.00 Hz, by pitch shifting each audio track by the increment and providing MIDI mote values to each processor associated with each software instrument corresponding to each MIDI track.

13. The system of claim 12, wherein the first processor is operative to collectively adjust the tempo by a percentage associated with the command, the percentage being between about negative fifty percent (−50%) and one-hundred percent (100%) of each track, and the tempo being adjusted for each audio track by time stretching and for each MIDI track by changing a clock signal of the MIDI data for each MIDI track with the pitch of each track being maintained.

14. The system of claim 13, wherein the first processor is operative to display the adjusted tempo of each track.

15. The system of claim 12, wherein the first processor is operative to collectively adjust the tempo and pitch by a percentage associated with the command, the percentage being between about negative fifty percent (−50%) and one-hundred percent (100%) of each track, and the tempo and pitch being adjusted for each audio track by time stretching and for the tempo of each MIDI track being adjusted by changing a clock signal and note values of the MIDI data for each MIDI track.

16. The system of claim 15, wherein the first processor is operative to display the adjusted tempo of each track.

17. The system of claim 12, wherein the display is operative to display a radio button for collectively adjusting at least one of the tempo, tempo and pitch, and tuning of each internal track and each external track.

* * * * *